US006856120B2

(12) United States Patent
Miyazaki

(10) Patent No.: US 6,856,120 B2
(45) Date of Patent: Feb. 15, 2005

(54) REGULATOR CIRCUIT

(75) Inventor: Takahiro Miyazaki, Oita (JP)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/179,051

(22) Filed: Jun. 25, 2002

(65) Prior Publication Data

US 2003/0006743 A1 Jan. 9, 2003

(30) Foreign Application Priority Data

Jun. 26, 2001 (JP) ..... 2001-193238

(51) Int. Cl.[7] ..... G05F 1/70
(52) U.S. Cl. ..... 323/211; 327/61
(58) Field of Search ..... 323/237, 246, 323/249, 251, 253, 211, 222; 363/17, 90, 89, 91, 93, 98, 80; 327/122, 103, 362, 561, 61, 91

(56) References Cited

U.S. PATENT DOCUMENTS 5,173,847 A * 12/1992 Suzuki ..... 363/80

6,480,311 B1 * 11/2002 Okuda et al. ..... 359/152

* cited by examiner

*Primary Examiner*—Rajnikant B. Patel
(74) *Attorney, Agent, or Firm*—W. Daniel Swayze, Jr.; W. James Brady; Frederick J. Telecky, Jr.

(57) ABSTRACT

A regulator circuit capable of reducing an increase in an output voltage during a sudden drop in a load current without increasing the power consumption during a steady state. When a current in load IL1 changes suddenly from a large current to a minute current during a steady state, electric charges are charged in capacitor CL1 due to a response delay of the negative feedback control, and an output voltage becomes higher than a target voltage. Then, voltage of node N34 drops, diode 31 gets turned off, and a voltage is held in capacitor 32. As a result, output of comparator 42 changes from a low level to a high level, and n-type MOS transistor 82 gets turned on. In addition, when the voltage between the gate and the source of n-type MOS transistor 50 becomes lower than the voltage of voltage source 71 due to a drop in the voltage of node N34, comparator 72 is also reverted to the high level.

5 Claims, 8 Drawing Sheets

REGULATOR CIRCUIT

FIELD OF THE INVENTION

The present invention pertains to a regulator circuit which regulates an output voltage to a desired voltage.

BACKGROUND OF THE INVENTION

FIG. 8 is an outlined circuit diagram showing an example configuration of a conventional series regulator. In the series regulator shown in FIG. 8, voltage of voltage source Vin is applied to drain N1 of an n-type MOS transistor, and capacitor CL and current load IL are connected between source N2 and the ground line.

In addition, resistors 2*a* and 2*b* for voltage detection are connected in series between source N2 of n-type MOS transistor 1 and the ground line, and midpoint N4 between them is connected to the negative (−) input terminal of differential amplifier circuit 3. The voltage of voltage source VR is applied to the positive (+) input terminal of differential amplifier circuit 3. The voltage difference between said positive (+) input terminal and negative (−) input terminal is amplified by differential amplifier circuit 3 and input to the gate of n-type MOS transistor 1.

In the series regulator with the aforementioned configuration, the error between the detected value of the source voltage of n-type MOS transistor 1 and its target value is amplified by differential amplifier circuit 3 and fed back to gate N4 of n-type MOS transistor 1 in order to regulate the output voltage supplied to current load IL.

For example, when the source voltage of n-type MOS transistor 1 increases, the voltage of node N3 where said voltage is divided by resistors 2*a* and 2*b* also increases. Accordingly, the output voltage of differential amplifier circuit 3 drops, and the source voltage of n-type MOS transistor 1 drops. Similarly, when the voltage of source N2 of n-type MOS transistor 1 drops, voltage of node N3 drops, the output voltage of differential amplifier circuit 3 increases, and the source voltage of n-type MOS transistor increases.

As described above, negative feedback is applied to the source voltage of n-type MOS transistor 1 in order for the voltage of node N3 and the voltage of voltage source VR to become almost the same.

Incidentally, in the case of the series regulator shown in FIG. 8, when the load current due to current load IL changes from a low current to a very small current suddenly, the output voltage control cannot be carried out in time to handle said change in the load current, and the current in current load IL ends up flowing into capacitor CL1, so that the output voltage increases. Once capacitor CL1 gets charged, it takes a long time for the charge in capacitor CL1 to be discharged because the very small current from current load IL and the current in resistors 2*a* and 2*b* are the only currents which can be used to discharge said charge, so that a condition in which the output voltage is higher than the target voltage continues for a long time.

As described above, if the condition in which the output voltage is higher than the target voltage continues, a part having a small voltage tolerance suffers a voltage stress, resulting in major problems, such as malfunctioning, a deteriorated characteristic, and an increased defect rate. In addition, although it is possible to lower the resistance values of resistors 2*a* and 2*b* to increase the current discharged from capacitor CL in order to increase the discharging speed, the amount of current consumed by resistors 2*a* and 2*b* increases under normal conditions where the output voltage and the target voltage match when this method is adopted, resulting in a problem of a small increase in the power consumption.

The present invention was made in consideration of said situation, and its purpose is to present a regulator circuit capable of reducing the increase in the output voltage when the load current drops suddenly without increasing the power consumption under normal conditions.

SUMMARY OF THE INVENTION

In accordance with one aspect of the present invention, the regulator circuit has a voltage output circuit which outputs a voltage in accordance with the level of a voltage control signal input, a peak hold circuit which holds the peak level of the aforementioned control signal on the polarity side where the aforementioned output voltage is increased at a prescribed attenuation rate, and a load control circuit which compares the level of the aforementioned control signal with the peak level held by the aforementioned peak hold circuit and changes the load impedance of the aforementioned voltage output circuit in accordance with the result of said comparison.

Ideally, the aforementioned peak hold circuit has an input terminal, an output terminal, a rectifying element connected between the aforementioned input terminal and the aforementioned output terminal, a capacitor connected between the aforementioned output terminal and a reference potential, and a constant-current source which supplies a prescribed constant-current to the aforementioned output terminal.

In addition, ideally, the aforementioned load control circuit has a comparator circuit which compares the level of the aforementioned control signal with the aforementioned peak level held in order to output a comparison signal and a transistor which becomes conductive in accordance with the aforementioned comparison signal in order to draw a current from the voltage output terminal of the aforementioned voltage output circuit.

In addition, the regulator circuit pertaining to the second aspect of the present invention has a power supply voltage input terminal, an output voltage supply terminal, a first transistor which is connected between the aforementioned power supply voltage input terminal and the aforementioned output voltage supply terminal in order to supply an output voltage in accordance with the control signal applied to a control terminal to the aforementioned output voltage supply terminal, a control signal output terminal which outputs the aforementioned control signal with the voltage corresponding to an error between the aforementioned output voltage and a desired voltage, a second transistor which is connected to the aforementioned output voltage supply terminal and becomes conductive in accordance with a signal applied to said control terminal in order to lead in a current from the aforementioned output voltage supply terminal, and a control circuit which compares the voltage of the aforementioned control signal with a prescribed voltage in order to output a signal in accordance with the result of said comparison into the control terminal of the aforementioned second transistor.

Ideally, the aforementioned voltage control circuit has a peak hold circuit which holds the peak voltage of the aforementioned control signal on the polarity side where the aforementioned output voltage is increased at a prescribed attenuation rate in order to supply a signal in accordance with the result of a comparison between the voltage of the aforementioned control signal and the aforementioned peak voltage to the control terminal of the aforementioned second transistor.

In addition, the aforementioned control circuit ideally has a first comparator circuit which compares the voltage of the aforementioned control signal with the voltage of the aforementioned output voltage supply terminal in order to output a comparison signal in accordance with the result of said comparison, a peak hold circuit which holds the peak voltage of the aforementioned control signal on the polarity side where the aforementioned output voltage is increased at a prescribed attenuation rate, and a comparator circuit which compares the voltage of the aforementioned peak voltage with the voltage of the aforementioned control signal in order to output a second comparison signal in accordance with the result of said comparison; and the aforementioned first comparison signal or the aforementioned second comparison signal is supplied to the control terminal of the aforementioned second transistor.

REFERENCE NUMERALS AS SHOWN IN THE DRAWINGS

In the figures, 10 represents a voltage output circuit; 11, 43, 50, 82 a n-type MOS transistor; 20, 60 a control signal output circuit; 21*a*, 21*b*, 61*a*, 61*b* a resistor; 22, 62 a differential amplifier circuit; 30 a peak hold circuit; 31 a diode; 32, CL, CL1 a capacitor; 33 a constant-current circuit; 40, 70 a load control circuit; 41, 71, VR1, VR2 a voltage source; 42, 72 a comparator; and 82 a OR circuit.

DESCRIPTION OF THE EMBODIMENTS

A first embodiment will be explained below in reference to FIG. 1.

Figure 1:
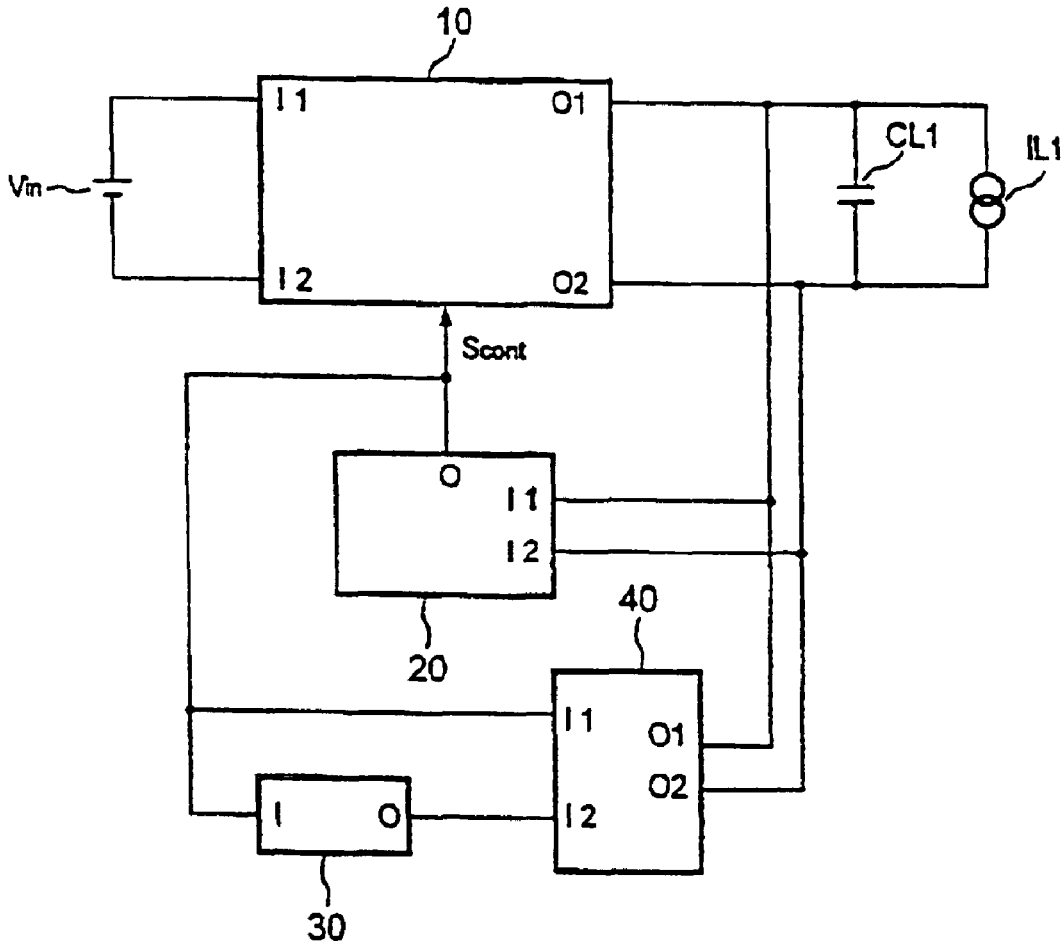
FIG. 1 is a schematic block diagram showing an example configuration of the regulator circuit pertaining to a first embodiment of the present invention.

FIG. 1 is an outlined block diagram showing an example configuration of the regulator circuit pertaining to the first embodiment of the present invention. The regulator circuit shown in FIG. 1 has voltage output circuit 10, control signal output circuit 20, peak hold circuit 30, and load control circuit 40.

Voltage output circuit 10 transforms the voltage of voltage source Vin supplied between terminals I1 and I2 in accordance with the level of control signal Scont and outputs it between terminals O1 and O2. In the example in FIG. 1, said output voltage is applied to capacitor CL1 and current load IL1.

Voltage output circuit 10 may be a series regulator type circuit, for example, in which the gate voltage of the transistor connected between terminals I1 and O1 is controlled to lower the voltage of voltage source Vin before it is output. Otherwise, it may also be a DC-DC converter containing a switching element.

Upon receiving the output voltage of voltage output circuit 10 through terminals I1 and I2, control signal output circuit 20 generates control signal Scont at the level corresponding to the error between the output voltage and the target voltage. Furthermore, the direction the level of control signal Scont changes is set such that the error between the output voltage and the target voltage is reduced.

Peak hold 30 holds the peak level of control signal Scont on the polarity side where the output voltage of voltage output circuit is increased at a prescribed attenuation rate.

For example, assuming that the output voltage of voltage output circuit 10 increases as the level of control signal Scont increases, the level held by peak hold circuit 30 also increases accordingly when the level of control signal Scont increases. When control signal Scont changed from an increase to a decrease, the peak level of held control signal Scont is kept held while it is attenuated gradually at the aforementioned attenuation rate.

Load control circuit 40 compares the level of control signal Scont input through terminal I1 with the peak level input through terminal I2 and held by peak hold circuit 30 and changes the load impedance between terminals O1 and O2 of voltage output circuit 10 according to the result of said comparison.

For example, whether the difference in the level between terminals I1 and I2 has exceeded a prescribed threshold level or not is determined; whereby, the load impedance is changed from high to low if it has exceeded the threshold level. In addition, when the condition in which the threshold level is exceeded has returned to the condition in which it is not exceeded, the load impedance is changed from low to high.

In such case, the hysteresis characteristic may be involved in the determination of whether the threshold level is exceeded or not. That is, different threshold levels are provided when changing from high load impedance to low load impedance and when changing from low load impedance to high load impedance. As a result, the load impedance does not change even when the level difference changes slightly due to a noise while the difference in the level between terminals I1 and I2 is near these threshold levels as long as said change is not significant enough to exceed the level difference between the threshold levels, so that noise-related malfunctioning can be prevented.

Here, the operation of the regulator circuit with the aforementioned configuration in FIG. 1 will be explained.

In the explanation below, a case in which the output voltage of voltage output circuit 10 also increases/decreases as the level of control signal Scont increases/decreases will be described, for example.

Voltage output circuit 10 and control signal output circuit 20 constitute a negative feedback loop used to approximate the output voltage to the target voltage. That is, when the output voltage of voltage output circuit 10 is higher than the target voltage, control signal output circuit 20 sets the level of control signal Scont to the direction which reduces it, and the output voltage drops accordingly. In addition, when the output voltage of voltage output circuit 10 is lower than the target voltage, control signal output circuit 20 sets the level of control signal Scont to the direction which increases it, and the output voltage increases accordingly.

During the normal operation of this negative feedback control as the steady state is reached in which the output voltage is almost equal to the target voltage as this negative feedback control operates normally, the level of control signal Scont will be almost fixed. On the other hand, when the current of current load IL1 drops suddenly from that of the steady state, the negative feedback control cannot catch up with said change in the current. Thus, a part of the current which is supposed to flow into current load IL1 flows into capacitor CL1, and the output voltage becomes higher than the target voltage. As a result, the level of control signal Scont begins to drop due to the aforementioned negative feedback control for having the output voltage follow-up with the target voltage.

At this time, the difference between said held peak level and control signal Scont increases because the level of control signal Scont in steady state is held as its peak level by peak hold circuit 30. In other words, when the current of current load IL1 drops suddenly, the level difference between terminals I1 and I1 of load control circuit 40 increases. Then, when said level exceeds a prescribed threshold level, the impedance between terminals O1 and O2 of voltage output circuit 10 is changed from high to low by load control circuit 40. As a result, the electric charge in capacitor CL1 gets discharged more quickly, and the output voltage drops fast.

As the output voltage drops, the output voltage gets closer to the target voltage and the level of control signal Scont stops dropping, starts rising, and gets closer to the steady state level. Then, when the level difference between the held peak level and control signal Scont gets close to the threshold level, the load impedance changes from low to high again, and capacitor CL1 stops discharging. Then, the negative feedback control returns to the steady condition once again.

Figure 8:
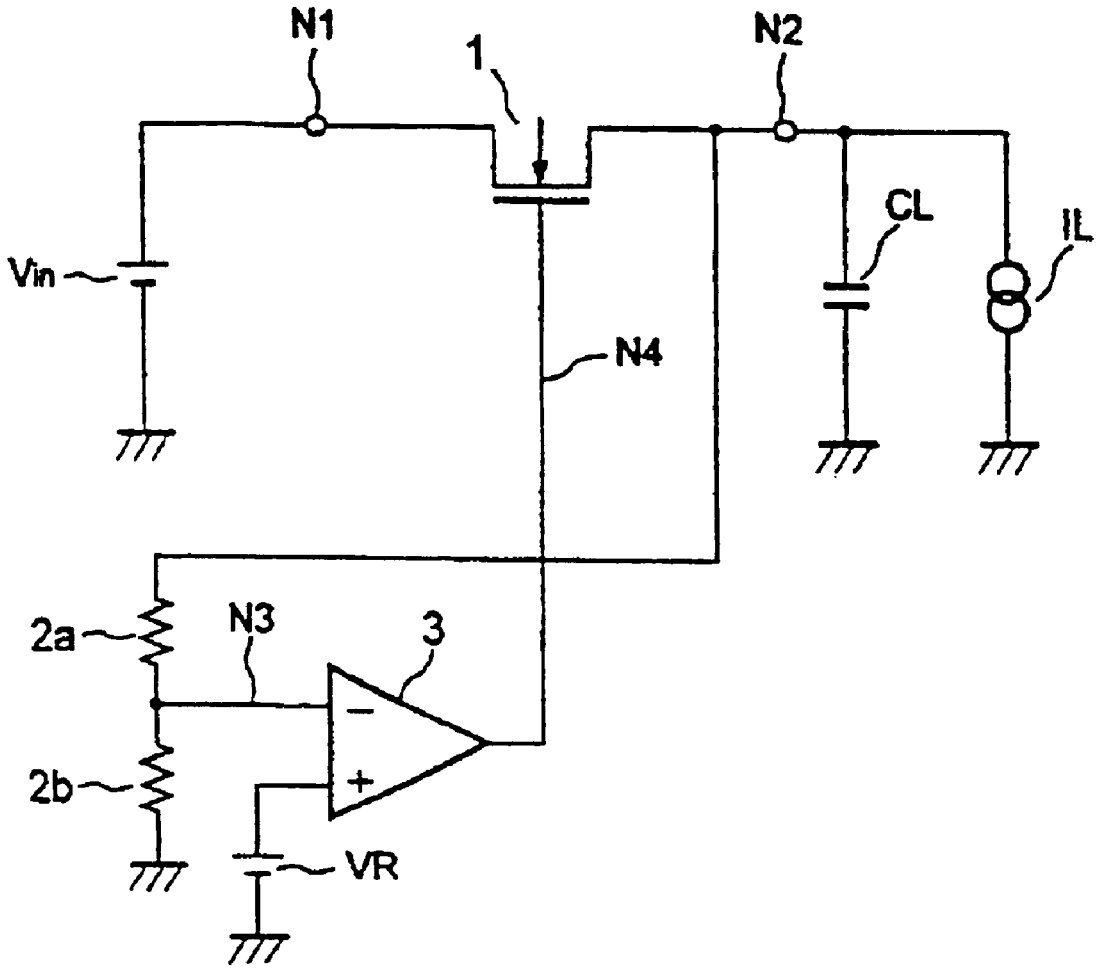
FIG. 8 is a schematic circuit diagram showing an example configuration of a conventional series regulator.

As described above, with the regulator circuit shown in FIG. 1, the condition in which the output voltage is higher than the target voltage as is evident in the case of the conventional series regulator shown in FIG. 8 can be prevented from lasting for a long time. As a result, circuit malfunction, deteriorated characteristics, and increased defect rate can be prevented.

In addition, the load impedance can be set to low only in the transitional condition in which the output voltage becomes higher than the target voltage, and the load impedance can be set to high during the steady state in which the output voltage becomes almost the same as the target voltage, so that a power consumption increase can be prevented.

Next, a second embodiment of the present invention will be explained in reference to FIGS. 2 and 3. In the second embodiment, the configuration of the aforementioned first embodiment is made more detailed.

Figure 2:
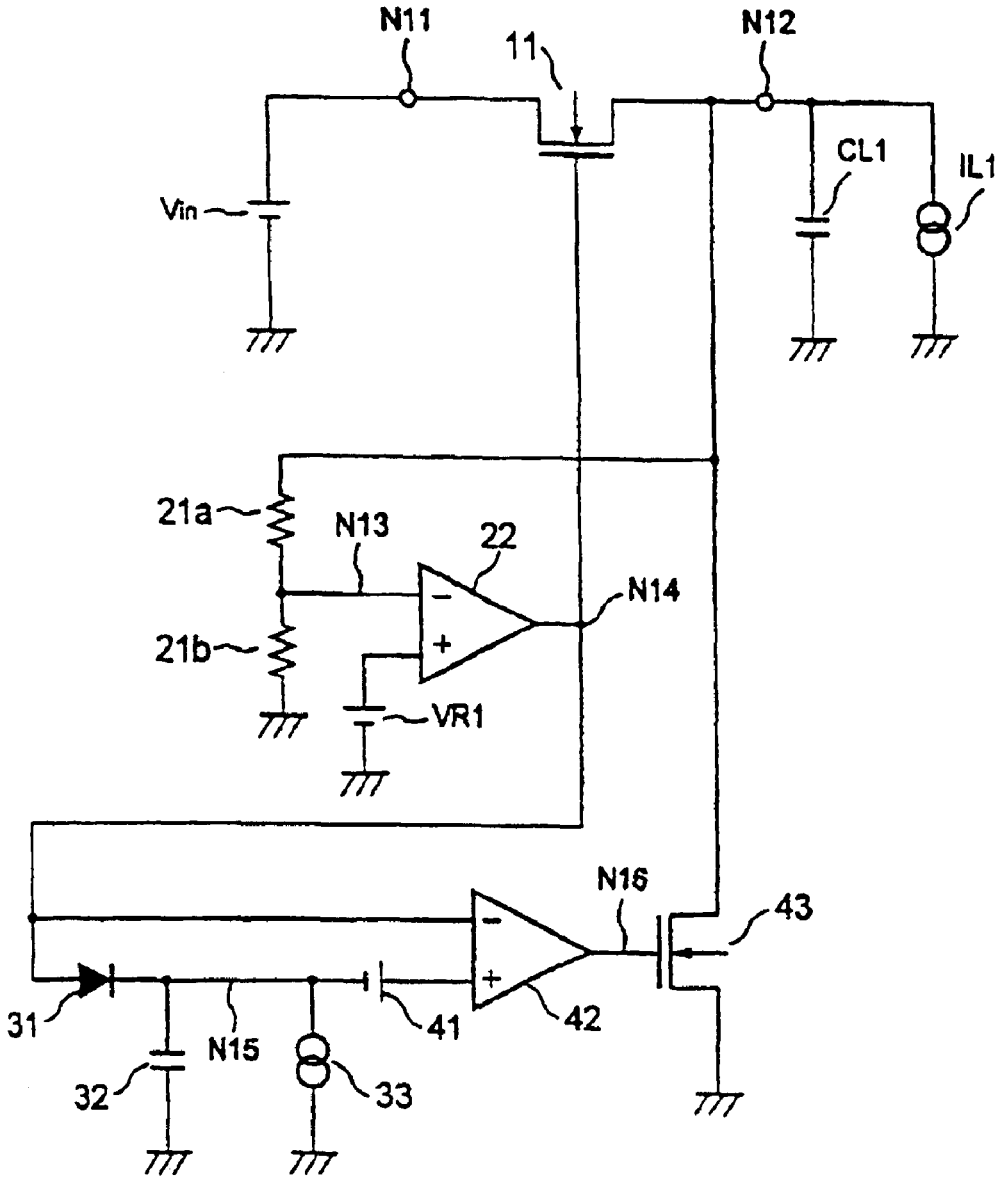
FIG. 2 is a schematic circuit diagram showing an example configuration of the regulator circuit pertaining to a second embodiment of the present invention.

FIG. 2 is a schematic circuit diagram showing an example configuration of the regulator circuit pertaining to the second embodiment of the present invention. Identical reference numerals in FIGS. 1 and 2 indicate identical constructional elements.

In addition, n-type MOS transistor 11 corresponds to voltage output circuit 10 in FIG. 1.

The circuit block containing resistors 21*a* and 21*b* and differential amplifier circuit 22 corresponds to control signal output circuit 20 in FIG. 1.

The circuit block containing diode 31, capacitor 32, and constant-current circuit 33 corresponds to peak hold circuit 30 in FIG. 1.

The circuit block containing voltage source 41, comparator 42, and n-type MOS transistor 43 corresponds to lead control circuit 40 in FIG. 1.

In FIG. 2, voltage of voltage source Vin is applied to drain N11 of n-type MOS transistor 11, and capacitor CL1 and current load IL1 are connected between source N12 and ground.

In addition, resistors 21*a* and 22*b* [sic.; 21*b*] connected in series for voltage detection are connected between source N12 of n-type MOS transistor 11 and ground, and midpoint N13 of said connection is connected to negative (−) input terminal of differential amplifier circuit 22. Voltage of voltage source VR1 is applied to positive (+) input terminal of differential amplifier circuit 22, and the voltage difference between said negative (−) input terminaland positive (+) input terminalis amplified and input into the gate of n-type MOS transistor 11.

In addition, output terminal N14 of differential amplifier circuit 22 is connected to negative (−) input terminal of comparator 42 as well as to the anode of diode 31. Capacitor 32 and constant-current circuit 33 are connected between cathode N15 of diode 15 and ground. Furthermore, cathode N15 of diode 31 is connected to the negative terminal of voltage source V41, and the positive terminal of voltage source V41 is connected to positive (+) input terminal of comparator 42.

Output terminal N16 of comparator 42 is connected to the gate of n-type MOS transistor 43. The drain of n-type MOS transistor 43 is connected to source N13 of n-type MOS transistor 11, and its source is connected to ground.

Figure 3:
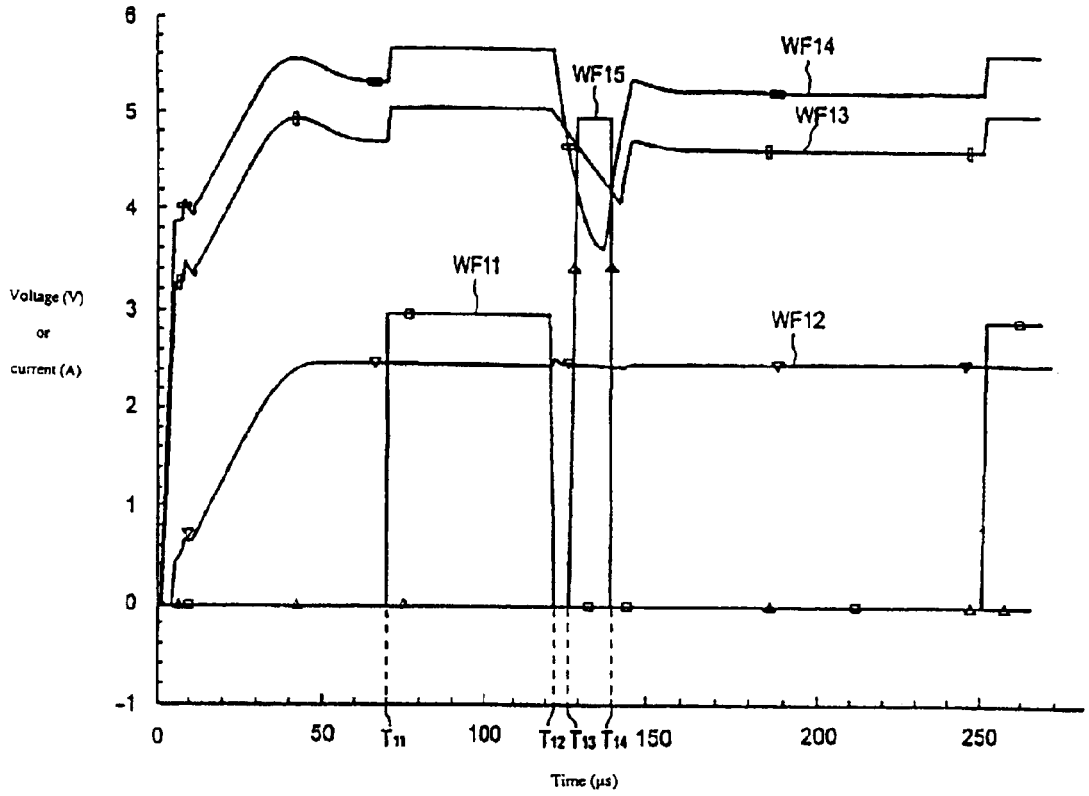
FIG. 3 is a diagram showing an example of the results of simulated voltage waveforms/current waveforms at respective parts of the regulator circuit shown in FIG. 2.

Here, the operation of the regulator circuit having the aforementioned configuration in FIG. 2 will be explained in reference to the voltage waveforms/current waveforms in respective parts as shown in FIG. 3.

FIG. 3 is a diagram showing an example of the results of simulated voltage waveforms/current waveforms at respective parts of the regulator circuit shown in FIG. 2; wherein, the vertical axis represents voltage value, and the horizontal axis represents time.

In addition, in FIG. 3, waveform WF11 represents the current waveform of current load IL1, waveform WF12 represents the source voltage waveform of n-type MOS transistor 11, waveform WF13 represents the voltage waveform of positive (+) input terminal of comparator 42, waveform WF14 represents the voltage waveform of negative (−) input terminal of comparator 42, and waveform WF15 represents the output voltage waveform of comparator 42.

Because the voltage of output terminal N14 of differential amplifier circuit 22 drops when the voltage of connection midpoint N13 between resistors 21*a* and 21*b* increases, and the gate voltage of n-type MOS transistor 11 drops accordingly, the source voltage of n-type MOS transistor 11 also drops. In addition, because the voltage of output terminal N14 of differential amplifier circuit 22 increases when the voltage of connection midpoint N13 drops, and the gate voltage of n-type MOS transistor 11 increases accordingly, the source voltage of n-type MOS transistor 11 also increases. Assuming that the gain of differential amplifier circuit 22 is sufficiently high, the source voltage of n-type MOS transistor 11 is controlled through the function of this negative feedback in such a manner that the voltage of connection midpoint N13 and the voltage of voltage source VR1 becomes almost equal.

Once the negative feedback control operates normally, and the steady state is reached in which the voltage of connection midpoint N13 and the voltage of voltage source VR1 becomes almost equal, the output voltage of differential amplifier circuit 22 becomes almost fixed. In addition, the voltage of cathode N15 of diode 31 is fixed to the voltage that is lower than the output voltage of differential amplifier circuit 22 by the voltage of diode 31 in the forward direction. Here, assuming that the voltage of voltage source 41 is sufficiently lower than the voltage of diode 31 in the forward direction, the voltage of positive (+) input terminal of comparator 42 becomes lower than the voltage of negative (−) input terminal, so that the output voltage of the comparator becomes low. Therefore, n-type MOS transistor 43 gets turned off.

On the other hand, when the current of current load IL1 drops suddenly from that in steady state, a part of the current flowing in current load IL1 flows into capacitor CL1, and the source voltage of n-type MOS transistor 11 increases because the negative feedback control cannot follow said change in the current.

For example, voltage waveform WF12 of node N12 increases slightly at time T12 in FIG. 3 where the current of current load IL1 drops suddenly from 3 A to 0 A.

When the voltage of connection midpoint N13 increases as the voltage of node N12 increases, the output voltage of differential amplifier circuit 22 begins to drop. Then, when the difference in the potential between output terminal N14 of differential amplifier circuit 22 and cathode N15 of diode 31 becomes smaller than the voltage of the diode in the forward direction, diode 31 is turned off, and the voltage of capacitor 32 is maintained. The voltage held in capacitor 32 drops at a fixed rate as constant-current circuit gets discharged.

For example, although the rate of voltage waveform WF13 of positive (+) input terminal of comparator 42 drops is slower than the rate of voltage waveform WF14 of negative (−) input terminal drops during the period between time T12 and time T14 in FIG. 13, the rate change of voltage waveforms WF13 and WF14 are approximately the same during other periods. This indicates that diode 31 is off during the period between time T12 and time T14.

In addition, when the voltage of negative (−) input terminal of comparator 42 becomes lower than the voltage of positive (+) input terminalheld by capacitor 32 as the output voltage of differential amplifier circuit 22 drops, the output voltage of comparator 42 changes from low level to high level, and n-type MOS transistor 43 gets turned on (time T13). As a result, the positive charge charged in capacitor CL1 gets discharged to the ground via n-type MOS transistor 43, and the source voltage of n-type MOS transistor 11 drops quickly.

When the voltage of connection midpoint N13 gets close to the voltage of voltage source VR1 as the source voltage of n-type MOS transistor 11 drops, the output voltage of differential amplifier circuit 22 stops dropping and starts increasing. Then, the voltage of negative (−) input terminal of comparator 42 becomes higher than the voltage of positive input terminal +, the output voltage of comparator 42 changes from high to low, n-type MOS transistor 43 gets turned off, and capacitor CL1 stops discharging (time T14). Then, the negative feedback control returns to the steady status once again.

As described above, with the regulator circuit shown in FIG. 2, the condition in which the output voltage is higher than the target voltage as is evident in the case of the conventional series regulator shown in FIG. 8 can be prevented from lasting for a long time. As a result, circuit malfunction, deteriorated characteristics, and increased defect rate can be prevented.

In addition, n-type MOS transistor 43 can be turned on only under the transitional condition in which the output voltage becomes higher than the target voltage, and the n-type MOS transistor can be turned off during the steady state in which the output voltage becomes almost the same as the target voltage, so that an increase in the power consumption can be prevented.

Furthermore, comparator 42 may be provided with a hysteresis characteristic. That is, the threshold voltage between the input terminals when the output voltage of comparator 42 changes from low to high, and the threshold voltage between the input terminals when it changes from high to low may be set to different voltages. As a result, the output level of comparator 42 does not change even when the voltage between the input terminals changes slightly by being affected with a noise while the voltage between the input terminals of comparator 42 is near these threshold voltages as long as said change is significant enough to exceed the voltage difference between the threshold voltages, so that noise-related malfunctioning can be prevented.

Next, a third embodiment of the present invention will be explained.

In the case of the regulator circuit shown in FIG. 2, the gate voltage of n-type MOS transistor 11 is held by the peak hold circuit, and said held voltage and the actual gate voltage are compared in order to detect an increase in the output voltage during a sudden change of the load. To the contrary, in the present embodiment, the gate voltage and the source voltage of the output transistor are compared in order to detect an increase in the output voltage during a sudden change of the load.

Figure 4:
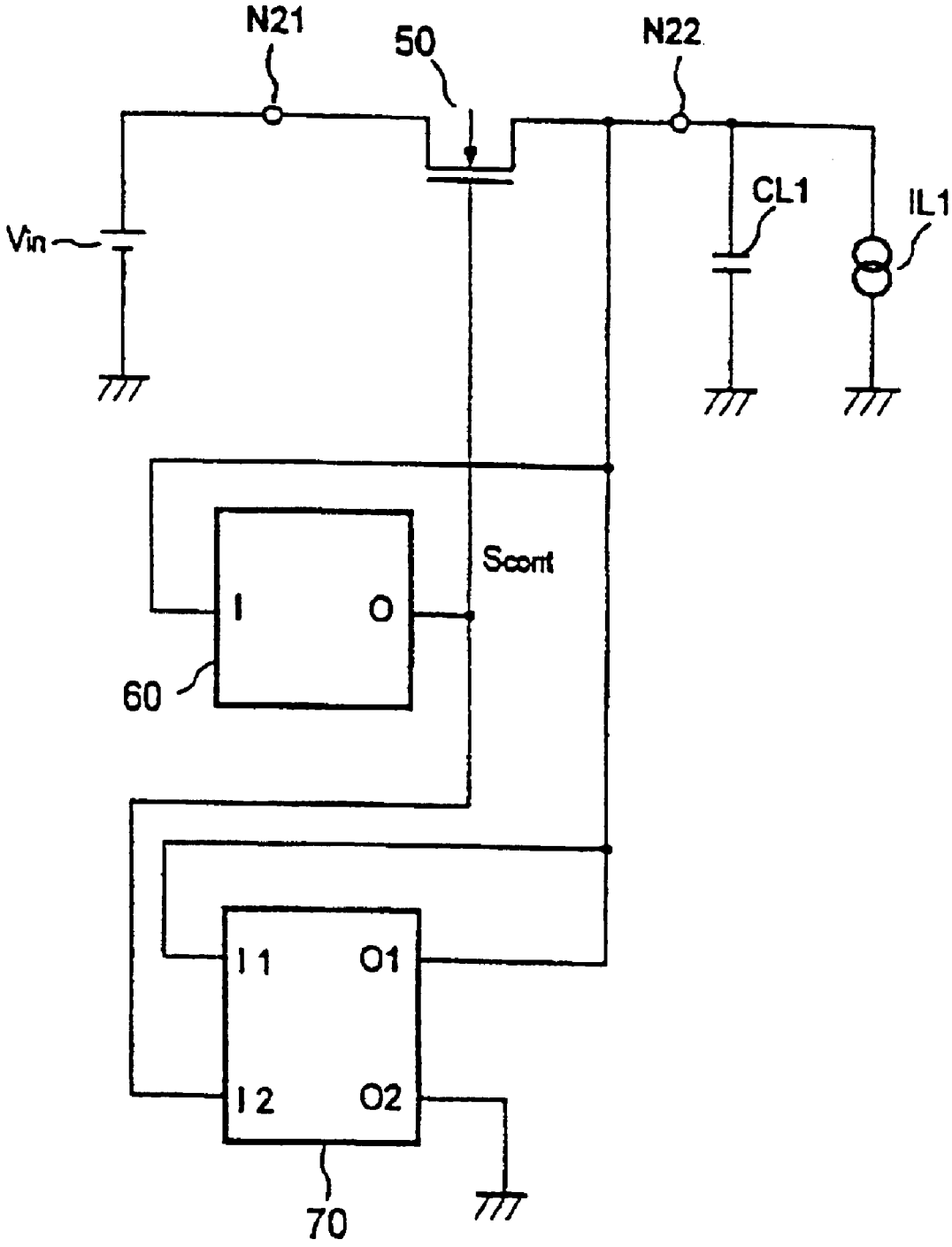
FIG. 4 is a schematic block diagram showing an example configuration of the regulator circuit pertaining to a third embodiment of the present invention.

FIG. 4 is a schematic block diagram showing an example configuration of the regulator circuit pertaining to the third embodiment of the present invention. The regulator circuit shown in FIG. 4 has n-type MOS transistor 50, control signal output circuit 60, and load control circuit 70.

Voltage of voltage source Vin is applied to drain N21 of n-type MOS transistor 50, and capacitor CL1 and current load IL1 are connected between source N22 and the ground line. In addition, control signal Scont from control signal output circuit 60 is input into the gate of n-type MOS transistor 50.

Voltage of source N22 of n-type MOS transistor 50 is input into control signal output circuit 60 in order to generate control signal Scont with the level corresponding to the error between said source voltage and the target voltage. Furthermore, the direction the level of control signal Scont changes is set such that the error between the voltage of source N22 and the target voltage is reduced.

Load control circuit 70 compares the source voltage of n-type MOS transistor 50 input through terminal I1 with the gate voltage of n-type MOS transistor 50 input through terminal I2 and changes the load impedance between source N22 of n-type MOS transistor 50 and ground according to the result of said comparison.

For example, whether the level difference between terminals I1 and I2 has exceeded a prescribed threshold level or not is determined; whereby, the load impedance is changed from high to low if the threshold level has been exceeded, and the load impedance is changed from low to high when the condition in which the threshold level is exceeded has returned to the condition in which it is not exceeded.

In such case, a hysteresis characteristic may be involved in the determination as to whether the threshold level is exceeded or not. That is, different threshold levels are provided when changing from high load impedance to low load impedance and when changing from low load impedance to high load impedance. As a result, the load impedance does not change even when the level difference changes slightly due to a noise while the difference in the level between terminals I1 and I2 is near these threshold levels as long as said change is not significant enough to exceed the level difference between the threshold levels, so that noise-related malfunctioning can be prevented.

Here, the operation of the regulator circuit with the aforementioned configuration in FIG. 4 will be explained.

When the source voltage of n-type MOS transistor 50 is higher than the target voltage, control signal output circuit 60 adjusts control signal Scont so as to lower its level, and the source voltage drops accordingly. In addition, when the source voltage of n-type MOS transistor 50 is lower than the target voltage, control signal output circuit 60 adjusts control signal Scont so as to increase its level, and the source voltage increases accordingly. Under the steady condition, the source voltage of n-type MOS transistor 50 and the target voltage become almost equal through this kind of negative feedback control.

On the other hand, when the current of current load IL1 drops suddenly from that of the steady condition, the negative feedback control cannot catch up with said change in the current. Thus, a part of the current which is supposed to flow into current load IL1 flows into capacitor CL1, and the source voltage of n-type MOS transistor 50 becomes higher than the target voltage. As a result, the voltage of control signal Scont begins to drop due to the aforementioned negative feedback control having the source voltage follow-up with the target voltage.

When the voltage of control signal Scont drops, and the voltage between the gate and the source of n-type MOS transistor 50 drops to the level lower than the threshold voltage of n-type MOS transistor 50, n-type MOS transistor 50 gets turned off. Then, when the voltage of control signal Scont keeps dropping until the level difference between terminals I1 and I2 exceeds the prescribed threshold level, the load impedance changes from high to low. As a result, the charge in capacitor CL1 gets discharged more quickly, so that the source voltage of n-type MOS transistor 50 drops quickly.

When the source voltage of n-type MOS transistor 50 gets close to the target voltage, the level of control signal Scont starts increasing and gets closer to the level under the steady condition. Then, when the level difference between terminals I1 and I2 of load control circuit 70 reaches the prescribed threshold level, the load impedance changes from low to high once again, and capacitor CL1 stops discharging. Then, the negative feedback control returns to the steady condition once again.

As described above, with the regulator circuit shown in FIG. 4, the condition in which the output voltage is higher than the target voltage, as is evident in the case of the conventional series regulator shown in FIG. 8, can be prevented from lasting for a long time. As a result, circuit malfunction, deteriorated characteristics, and increased defect rate can be prevented.

In addition, the load impedance can be set to low only in the transitional condition in which the output voltage becomes higher than the target voltage, and the load impedance can be set to high during the steady state in which the output voltage becomes almost the same as the target voltage, so that an increase in the power consumption can be prevented.

Next, a fourth embodiment of the present invention will be explained in reference to FIGS. 5 and 6.

In the fourth embodiment, the configuration of the aforementioned third embodiment is made more detailed.

Figure 5:
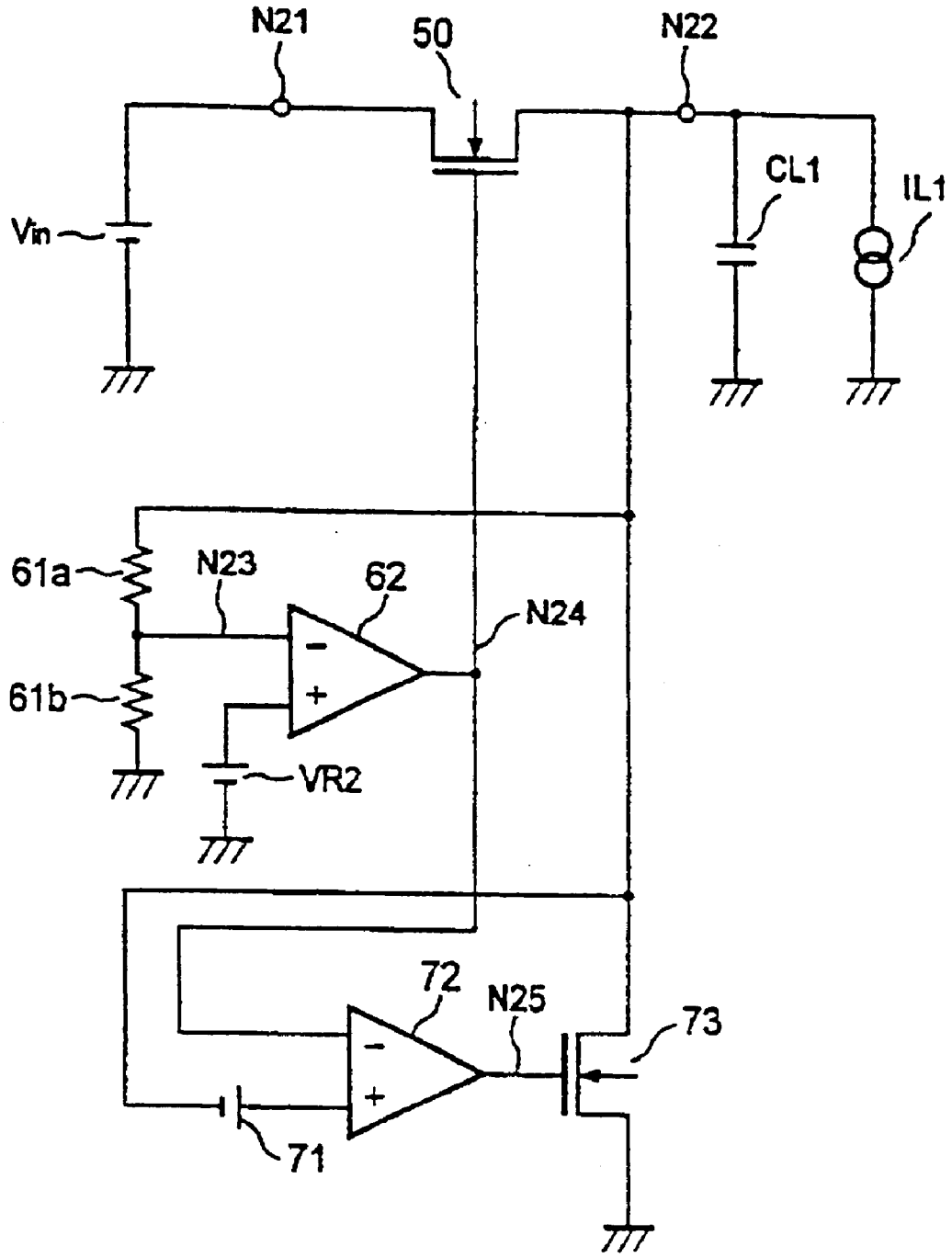
FIG. 5 is a schematic circuit diagram showing an example configuration of the regulator circuit pertaining to a fourth embodiment of the present invention.

FIG. 5 is a schematic circuit diagram showing an example configuration of the regulator circuit pertaining to the fourth embodiment of the present invention; wherein, the same symbols in FIGS. 5 and 4 indicate the same constituents.

Furthermore, the circuit block containing resistors 61*a* and 61*b* and differential amplifier circuit 62 corresponds to control signal output circuit 60 in FIG. 4.

The circuit block containing voltage source 71, comparator 72, and n-type MOS transistor 73 corresponds to lead control circuit 70 in FIG. 4.

In FIG. 5, resistors 61*a* and 61*b* for voltage detection are connected in series between source N22 of n-type MOS transistor 50 and ground, and connection midpoint N23 between them is connected to negative (−) input terminal of differential amplifier circuit 62. Voltage of voltage source VR2 is applied to positive (+) input terminal of differential amplifier circuit 62, and the voltage difference between said negative (−) input terminal and positive (+) input terminal is amplified and input into gate N24 of n-type MOS transistor 50.

Negative (−) input terminal of comparator 72 is connected to gate N24 of n-type MOS transistor 50, and positive (+) input terminal is connected to source N22 of n-type MOS transistor 50 from the positive terminal of voltage source 71 via its negative terminal. In addition, output voltage of comparator 72 is input into gate N25 of n-type MOS transistor 73. The drain of n-type MOS transistor 73 is connected to source N22 of n-type MOS transistor 50, and the source is connected to ground.

Figure 6:
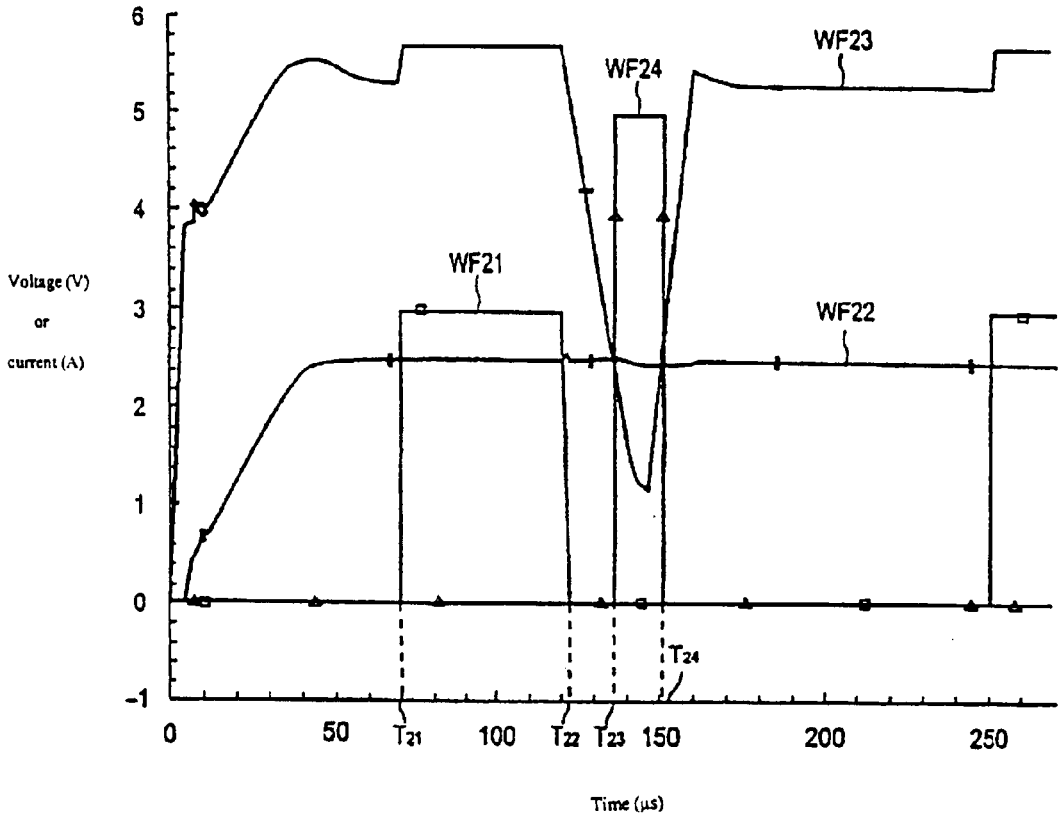
FIG. 6 is a diagram showing an example of the results of simulated voltage waveforms/current waveforms at respective parts of the regulator circuit shown in the Figure.

Here, the operation of the regulator circuit having the aforementioned configuration in FIG. 5 will be explained in reference to the voltage waveforms/current waveforms in respective parts as shown in FIG. 6.

FIG. 6 is a diagram showing an example of the results of the simulated voltage waveforms/current waveforms at respective parts of the regulator circuit shown in FIG. 5; wherein, the vertical axis represents voltage value, and the horizontal axis represents time.

In addition, in FIG. 6, waveform WF21 represents the current waveform of current load IL1, waveform WF22 represents the source voltage waveform of n-type MOS transistor 50, waveform WF23 represents the gate voltage waveform of n-type MOS transistor 50, and waveform WF24 represents the output voltage waveform of comparator 72.

The source voltage of n-type MOS transistor 50 also drops because the voltage of output terminal N24 of differential amplifier circuit 62 drops when the voltage of connection midpoint N23 between resistors 61*a* and 61*b* increases, and the gate voltage of n-type MOS transistor 50 drops accordingly. In addition, because the voltage of output terminal N24 of differential amplifier circuit 62 increases when the voltage of connection midpoint N23 drops, and the gate voltage of n-type MOS transistor 50 increases accordingly, the source voltage of n-type MOS transistor 50 also increases. Assuming that the gain of differential amplifier circuit 62 is sufficiently high, the source voltage of n-type MOS transistor 50 is controlled through the function of this negative feedback in such a manner that the voltage of connection midpoint N23 and the voltage of voltage source VR2 become almost the same.

In the steady state in which the voltage of connection midpoint N23 and the voltage of voltage source VR2 become almost the same, the voltage between the gate and the source of n-type MOS transistor 50 is usually near the threshold voltage of n-type MOS transistor 50. Assuming that the voltage of voltage source V71 is lower than the voltage between the gate and the source at this time, the voltage of negative (−) input terminal of comparator 72 becomes higher than that of positive input terminal +, and the output voltage of comparator 72 becomes low. Therefore, in the steady state, n-type MOS transistor 73 is off.

On the other hand, when the current of current load IL1 drops suddenly from that of the steady state, a part of the current which is supposed to flow into current load IL1 flows into capacitor CL1 because the negative feedback control cannot catch up with said change in the current, and the source voltage of n-type MOS transistor 50 increases.

For example, at time T22 in FIG. 6 where the current of current load IL1 drops suddenly from 3 A to 0 A, source voltage waveform WF22 of n-type MOS transistor 50 increases slightly.

When the voltage of connection midpoint N23 increases as the source voltage of n-type MOS transistor 50 increases, the output voltage of differential amplifier circuit 62 starts dropping. As a result, when the voltage between the gate and the source of n-type MOS transistor 50 drops to the level lower than the threshold voltage of n-type MOS transistor 50, n-type MOS transistor 50 gets turned off. Then, the output voltage of differential amplifier circuit 62 keeps dropping, and when the voltage of negative (−) input terminal of comparator 72 becomes lower than that of positive input terminal +, the output voltage of comparator 72 changes from low to high, and n-type MOS transistor 73 gets turned on (time T23). As a result, the positive charge in capacitor CL1 gets discharged to the ground via n-type MOS transistor 73, and the source voltage of n-type MOS transistor 50 drops quickly.

When the voltage of connection midpoint N23 gets close to the voltage of voltage source VR2 as the source voltage of n-type MOS transistor 50 drops, the output voltage of differential amplifier circuit 62 stops dropping and starts increasing. Then, the voltage of negative (−) input terminal of comparator 72 becomes higher than that of the positive input terminal, the output voltage of comparator 72 changes from high to low, n-type MOS transistor 73 gets turned off, and capacitor CL1 stops discharging (time T24). Then, the negative feedback control returns to the steady state once again.

As described above, with the regulator circuit shown in FIG. 5, the condition in which the output voltage is higher than the target voltage, as is evident in the case of the conventional series regulator shown in FIG. 8, can be prevented from lasting for a long time. As a result, circuit malfunction, deteriorated characteristics, and increased defect rate can be prevented.

In addition, n-type MOS transistor 73 can be turned on only under the transitional condition in which the output voltage becomes higher than the target voltage, and it can be turned off during the steady state in which the output voltage becomes almost the same as the target voltage, so that an increase in the power consumption can be prevented.

Furthermore, comparator 72 may be provided with a hysteresis characteristic. That is, the threshold voltage between the input terminals when the output voltage of comparator 72 changes from the low level to the high level and the threshold voltage between the input terminals when it changes from the high level to the low level may be set to different voltages. As a result, the output level of comparator 72 does not change even when the voltage between the input terminals changes slightly from the noise effects while the voltage between the input terminals of comparator 72 is near these threshold voltages as long as said change is significant enough to exceed the voltage difference between the threshold voltages, so that noise-related malfunctioning can be prevented.

Next, a fifth embodiment of the present invention will be explained in reference to FIG. 7.

Figure 7:
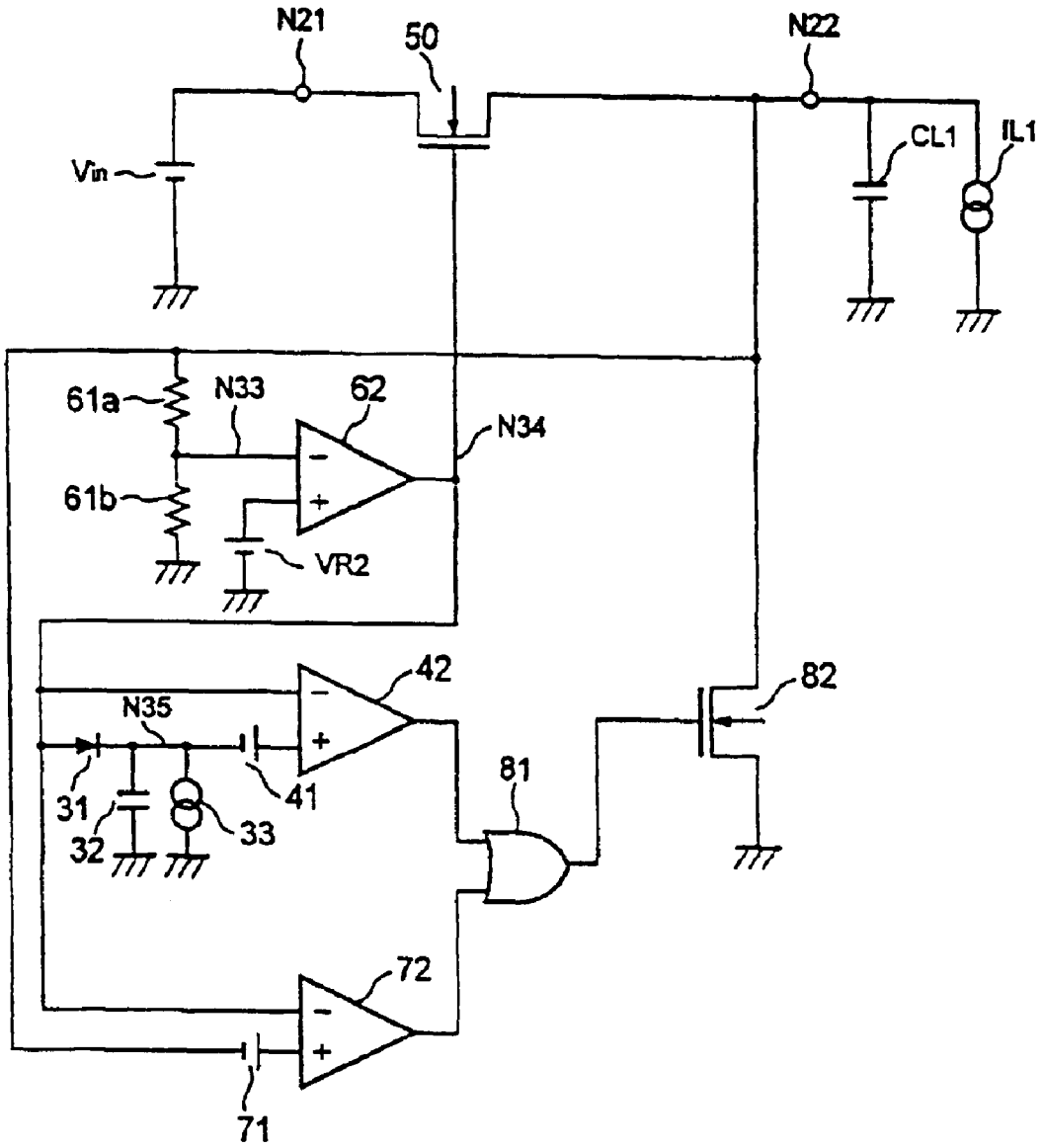
FIG. 7 is a schematic circuit diagram showing an example configuration of the regulator circuit pertaining to a fifth embodiment of the present invention.

In the embodiment in FIG. 7, the configuration of the third embodiment is added to the configuration of the aforementioned fourth embodiment.

FIG. 7 is a schematic circuit diagram showing an example configuration of the regulator circuit pertaining to the fifth embodiment of the present invention; wherein, the same symbols in FIGS. 5 and 7 indicate the same constituents.

As shown in FIG. 7, the block for the peak hold circuit (diode 31, capacitor 32, and constant-current circuit 33) and the block for the comparator circuit (voltage source 41 and comparator 42) in FIG. 2 are added to the configuration in FIG. 5, but n-type MOS transistor 73 was not added.

Then, the output voltages of comparators 42 and 72 are combined by OR circuit 81, and the output voltage of OR circuit 81 is applied to the gate of n-type MOS transistor 82. The drain of n-type MOS transistor 82 is connected to source N32 of n-type MOS transistor 50, and its source is connected to ground.

In the aforementioned regulator circuit with the aforementioned configuration in FIG. 7, the output voltages of comparators 42 and 72 are set to the high or the low level in the same manner as that already described in the third and the fourth embodiments. Then, the output voltage of OR circuit 81 becomes of high when at least either comparator 42 or 72 is at the high level, and n-type MOS transistor 82 is turned on at this time.

Therefore, in the case of the regulator circuit shown in FIG. 7, too, like the regulator circuits shown in FIGS. 2 and 5, the condition in which the output voltage is higher than the target voltage can be prevented from lasting for a long time. In addition, n-type MOS transistor 73 can be turned on only under the transitional condition in which the output voltage becomes higher than the target voltage, and it can be turned off during the steady state in which the output voltage becomes almost the same as the target voltage, so that an increase in the power consumption can be prevented.

In addition, in the case of the regulator circuit in FIG. 2, if the attenuation rate of the voltage held by capacitor 32 of the peak hold circuit block is too slow, the output of comparator 42 becomes erroneously high over a long period of time when the gate voltage of n-type MOS transistor 50 changes in a vibrating manner during a sudden change in the load current, or when capacitor 32 gets mistakenly charged due to a noise, and the consumption of the current may be increased. Thus, said attenuation rate needs to be set such that the aforementioned erroneous operations in error can be prevented. However, if said attenuation rate is low, the voltage held in capacitor 32 drops before capacitor CL1 gets charged sufficiently, so that the load impedance may return to high while the output voltage remains higher than the target voltage.

On the other hand, in the case of the regulator circuit shown in FIG. 5, because the threshold voltage of n-type MOS transistor 50 is subject to production-related variations, the voltage of voltage source 71 needs to be set at a relatively high voltage. Accordingly, the operation time of the comparator may become slower than that of the regulator circuit in FIG. 2.

To the contrary, in the case of the regulator circuit shown in FIG. 7 in which the configurations in FIGS. 2 and 5 are combined, not only can an increase in the output voltage during a sudden change in the load be detected more quickly than in the case of the regulator circuit shown in FIG. 5, but capacitor CL1 can also be discharged reliably without being affected by the time restriction imposed by the attenuation rate of the peak hold circuit block.

Furthermore, the present invention is not limited to the aforementioned first through the fifth embodiments, and various kinds of modifications known to those in the field can be made.

For example, the MOS transistor used in FIGS. 2, 5, and 7 may be replaced with a bipolar transistor.

In addition, the n-type MOS transistor used in FIGS. 2, 5, and 7 may be replaced with a p-type MOS transistor.

With the present invention, an increase in the output voltage during a sudden drop in the load current can be reduced without increasing the power consumption in the steady state.

What is claimed is:

1. A regulator circuit having a voltage output circuit which provides a voltage in accordance with voltage level of a control signal input, a peak hold circuit which holds the peak level of the control signal on the polarity side where the output voltage is increased at a prescribed attenuation rate, and a load control circuit which compares the level of the control signal with the peak level held by the peak hold circuit and changes the load impedance of the voltage output circuit in accordance with the result of said comparison.

2. The regulator circuit described in claim 1, wherein the peak hold circuit has an input terminal, an output terminal, a rectifying element connected between the input terminal and the output terminal, a capacitor connected between the output terminal and a reference potential, and a constant-current source which supplies a prescribed constant-current to the output terminal.

3. The regulator circuit described in claim 2, wherein the load control circuit has a comparator circuit which compares the level of the control signal with the peak level held in order to output a comparison signal and a transistor which becomes conductive in accordance with the comparison signal in order to draw current from the voltage output terminal of the voltage output circuit.

4. A regulator circuit comprising:

a power supply voltage input terminal, an output voltage supply terminal, a first transistor which is coupled between the power supply voltage input terminal and the output voltage supply terminal in order to supply an output voltage in accordance with the control signal applied to a control terminal to the output voltage supply terminal, a control signal output terminal which provides the control signal with a voltage corresponding to an error between the output voltage and a desired voltage, a second transistor which is coupled to the output voltage supply terminal and becomes conductive in accordance with a signal applied to the control terminal in order to draw a current from the output voltage supply terminal, and a control circuit which compares the voltage of the control signal with a prescribed voltage in order to generate a signal in accordance with the result of the comparison into the control terminal of the second transistor, wherein the voltage control circuit has a peak hold circuit which holds the peak voltage of the control signal on the polarity side where the output voltage is increased at a prescribed attenuation rate in order to supply a signal in accordance with the result of a comparison between the voltage of the control signal and the peak voltage to the control terminal of the second transistor.

5. A regulator circuit comprising:

a power supply voltage input terminal, an output voltage supply terminal, a first transistor which is coupled between the power supply voltage input terminal and the output voltage supply terminal in order to supply an output voltage in accordance with the control signal applied to a control terminal to the output voltage supply terminal, a control signal output terminal which provides the control signal with a voltage corresponding to an error between the output voltage and a desired voltage, a second transistor which is coupled to the output voltage supply terminal and becomes conductive in accordance with a signal applied to the control terminal in order to draw a current from the output voltage supply terminal, and a control circuit which compares the voltage of the control signal with a prescribed voltage in order to generate a signal in accordance with the result of the comparison into the control terminal of the second transistor, wherein the control circuit has a first comparator circuit which compares the voltage of the control signal with the voltage of the output voltage supply terminal in order to generate a comparison signal in accordance with the result of the comparison, a peak hold circuit which holds the peak voltage of the control signal on the polarity side where the output voltage is increased at a prescribed attenuation rate, and a comparator circuit which compares the voltage of the peak voltage with the voltage of the control signal in order to generate a second comparison signal in accordance with the result of the comparison; and the first comparison signal or the second comparison signal is supplied to the control terminal of the second transistor.

* * * * *